US009328616B2

(12) United States Patent
Heselhaus

(10) Patent No.: US 9,328,616 B2
(45) Date of Patent: May 3, 2016

(54) FILM-COOLED TURBINE BLADE FOR A TURBOMACHINE

(71) Applicant: Andreas Heselhaus, Düsseldorf (DE)

(72) Inventor: Andreas Heselhaus, Düsseldorf (DE)

(73) Assignee: SIEMENS AKTIENGESELLSCHAFT, Munich (DE)

( * ) Notice: Subject to any disclaimer, the term of this patent is extended or adjusted under 35 U.S.C. 154(b) by 542 days.

(21) Appl. No.: 13/756,653

(22) Filed: Feb. 1, 2013

(65) Prior Publication Data

US 2014/0219814 A1 Aug. 7, 2014

(51) Int. Cl.
*F01D 5/18* (2006.01)

(52) U.S. Cl.
CPC ..... *F01D 5/186* (2013.01); *F05D 2260/209* (2013.01); *F05D 2260/2212* (2013.01)

(58) Field of Classification Search
CPC ..... B22C 7/02; B22C 7/06; B22C 9/04; B22C 9/10; F01D 5/186; F01D 5/187; F01D 5/14; F01D 5/147; F05D 2230/21
See application file for complete search history.

(56) References Cited

U.S. PATENT DOCUMENTS

| | | | | |
|---|---|---|---|---|
| 5,392,515 | A | 2/1995 | Auxier | |
| 5,624,231 | A * | 4/1997 | Ohtomo et al. | 416/97 R |
| 5,779,438 | A * | 7/1998 | Wilfert | 415/115 |
| 7,186,085 | B2 * | 3/2007 | Lee | 416/97 R |
| 2004/0047724 | A1 * | 3/2004 | Liang | 415/115 |
| 2008/0279697 | A1 | 11/2008 | Liang | |
| 2010/0239409 | A1 * | 9/2010 | Draper | 415/1 |

FOREIGN PATENT DOCUMENTS

| | | | |
|---|---|---|---|
| DE | 10236676 | A1 | 2/2004 |
| GB | 2262314 | A | 6/1993 |
| WO | WO 9837310 | A1 | 8/1998 |

* cited by examiner

*Primary Examiner* — Christopher Verdier

(57) ABSTRACT

A turbine blade for a turbomachine has an outer wall which delimits an inner cavity. Cooling fluid flows in the inner cavity. A through duct is arranged in the outer wall through which the cooling fluid flows from the inner cavity to an outside of the turbine blade. The through duct is inclined with respect to a trailing edge of the turbine blade, wherein a marginal portion of an entrance of the through duct is designed on an upstream side to be sharp-edged in relation to other marginal portions of the entrance such that a separation zone of a cooling fluid flow is formed in the through duct. A pair of swirls builds up in the through duct, wherein velocity vectors of the cooling fluid flow between the swirl centers point toward a downstream side of the through duct.

4 Claims, 3 Drawing Sheets

FILM-COOLED TURBINE BLADE FOR A TURBOMACHINE

FIELD OF INVENTION

A turbine blade for a turbomachine, the turbine blade being film-cooled, is provided.

BACKGROUND OF INVENTION

A turbomachine, in particular a gas turbine, has a turbine in which hot gas, which has previously been compressed in a compressor and heated in a combustion chamber, is expanded in order to perform work. For high mass flows of the hot gas and therefore for high power output ranges of the gas turbine, the turbine is designed in an axial type of construction, the turbine being formed by a plurality of blade rings lying one behind the other in the through-flow direction. The blade rings have moving blades and guide vanes arranged over the circumference, the moving blades being fastened to a rotor of the gas turbine and the guide vanes being fastened to the casing of the gas turbine.

The thermodynamic efficiency of the gas turbine is the higher, the higher the inlet temperature of the hot gas into the turbine is. By contrast, limits are placed upon the thermal load-bearing capacity of the turbine blades. It is therefore desirable to provide turbine blades which, despite as high a thermal load as possible, have mechanical strength sufficient for the operation of the gas turbine. For this purpose, appropriate materials and material combinations are available for the turbine blades, but, according to the current state of the art, allow only inadequate exploitation of the potential for increasing the thermal efficiency of the gas turbine. For a further increase in the permissible turbine inlet temperature, it is known to cool the turbine blades during the operation of the gas turbine, with the result that the turbine blade itself is exposed to lower thermal load than would be the case without cooling because of the thermal load caused by the hot gas.

In order to keep the temperature of the turbine blades low, the blades are cooled, for example, by means of film cooling. For this purpose, the blades are provided on their surface with a plurality of cooling air holes, via which cooling air is transported from the blade interior to the surface of the turbine blades. After the cooling air has left the cooling air holes, it flows in the form of a film along the surface of the turbine blade and thus insulates the surface of the turbine blade from the hot gas. Furthermore, the film acts as a barrier, so that transport of the hot gas to the surface of the turbine blade is suppressed.

SUMMARY OF INVENTION

An object is to provide a turbine blade for a turbomachine which is cooled effectively by film cooling.

The turbine blade for a turbomachine has an outer wall which delimits an inner cavity of the turbine blade. In the inner cavity cooling fluid is provided for film cooling of the turbine blade. At least one through duct is located in the outer wall through which the cooling fluid flows from the inner cavity to an outside the turbine blade so as to form a cooling film on an outer face of the outer wall. The at least one through duct is inclined with respect to a trailing edge of the turbine blade. A marginal portion of the entrance of the through duct is designed on an upstream side to be sharp-edged in relation to other marginal portions of the entrance such that a separation zone of the cooling fluid flow is formed in the at least one through duct. The separation zone induces a centric transverse flow of the cooling fluid which is directed toward a side of the at least one through duct which lies opposite the separation zone. A pair of contra-directional vortices (swirls) develops in the at least one through duct, wherein velocity vectors of the cooling fluid flow between vortex centers point toward a downstream side of the at least one through duct.

When a hot gas from a combustion chamber of the turbomachine impinges on the outside of the turbine blade onto a jet of the cooling fluid which has emerged from the through duct, the flow of hot gas is divided around the jet, and a chimney vortex with two vortex arms is formed as a result of the drag effect of the hot gas at the jet margin. Each of the two vortex arms is formed by a vortex, the velocity vectors of the hot gas on the two inner faces of the vortex arms pointing away from the outer wall. The hot gas is thereby transported in the direction of the outside of the turbine blade. The two vortex arms of the chimney vortex have oppositely directed directions of rotation to the vortices, in each case overlaid with them, of the pair of contra-directional vortices of the cooling fluid. The chimney vortex is thus weakened and the transport of the hot gas to the outside of the turbine blade is reduced, with the result that the film cooling becomes more effective. As a result, the cooling fluid quantity necessary for cooling the turbine blade is lower than a cooling fluid quantity which would be necessary to cool a conventional turbine blade, this being accompanied by higher efficiency of the turbomachine. Furthermore, the selected density of arrangement of the through ducts in the turbine blade can be comparatively low, as result of which, overall, fewer through ducts are required for the turbine blade and structural weakening of the turbine blade is lower.

It is preferable that, on the inner face of that region of the outer wall in which the through duct is arranged, a thickening is provided, having an upstream front side in which the entrance is formed and which is inclined with respect to the axis of the through duct in such a way that the marginal portion of the entrance of the through duct is designed on its upstream side to be more sharp-edged than the opposite marginal portion of the entrance. The front side of the thickening is preferably arranged essentially perpendicularly to the inner face of the outer wall or at an inclination with respect to the trailing edge of the turbine blade. At the inclined front side of the thickening, an especially sharp-edged marginal portion is obtained on the upstream side of the through duct, with the result that the pair of contra-directional vortices is advantageously formed to an especially pronounced extent.

The thickening preferably has in its extent of thickness such large dimensioning that, in the case of the manufacturing inaccuracies which always occur during casting, the through duct is still arranged within the thickening and the entrance is formed by the front side of the thickening. The rear side of the thickening facing away from the front side of the thickening is preferably essentially parallel to the through duct. The thickening is preferably a cooling rib of the turbine blade. By the cooling rib being provided, the surface of the inside of the turbine blade is enlarged, with the result that the turbine blade can advantageously be cooled effectively from inside by the cooling fluid by convection. Alternatively, the thickening is preferably a supporting web running from the pressure side of the turbine blade to its suction side. The strength of the turbine blade is advantageously increased by the supporting web. Individual cooling ducts of the blade are formed in the blade interior by the supporting webs.

It is preferable that the thickening is a displacement body in the inner cavity of the turbine blade, by means of which displacement body the flow velocity of the cooling fluid in the inner cavity can be increased for the purpose of cooling the turbine blade, with the result that convection by the cooling fluid in the inner cavity is increased. The turbine blade can thereby likewise advantageously be cooled effectively from inside.

Alternatively, it is preferable that the inner face of that region of the outer wall in which the through duct is arranged is arranged essentially parallel to the outer face, and a bead is integrally formed on the marginal portion of the entrance of the through duct on its downstream side in such a way that this marginal portion is designed to be blunt in relation to the opposite marginal portion of the entrance. This shape for the turbine blade is simple to cast. In the event of manufacturing inaccuracies possibly occurring during the casting of the turbine blade, the ultimate position of the bead cannot be predicted exactly from the outset. In this case, the position of the bead can be determined subsequently with the aid of an X-ray method. On the basis of this determined position, the through duct can be produced in the correct position in relation to the bead from outside the turbine blade, for example by drilling.

On the inner face of that region of the outer wall in which the through duct is arranged, a clearance is preferably provided, having a downstream rear side in which the entrance is formed and which is inclined with respect to the axis of the through duct in such a way that the marginal portion of the entrance of the through duct is designed on its upstream side to be more sharp-edged than the opposite marginal portion of the entrance. By the clearance being provided, the demand for material for producing the turbine blade is low. Preferably, the rear side of the clearance is arranged essentially perpendicularly to the inner face of the outer wall or at an inclination with respect to the trailing edge of the turbine blade. The inclined rear side advantageously gives rise to an especially sharp-edged marginal portion on the upstream side of the through duct. The clearance preferably is of round shape at its inlet margin in such a way that the cooling fluid can flow, free of separation, into the clearance.

The shape of the turbine blade is appropriate for casting purposes, with the result that it becomes possible that the turbine blade can be produced by casting without any further adaptations. The through ducts are preferably to be produced by drilling, in particular laser drilling, or erosion. Drilling is usually carried out from outside the turbine blade.

The clearance is preferably a groove into which a plurality of through ducts issue. In this case, it is advantageously simpler, during drilling, to find the groove and at the same time form the marginal portions.

DETAILED DESCRIPTION OF INVENTION

Figure 1:
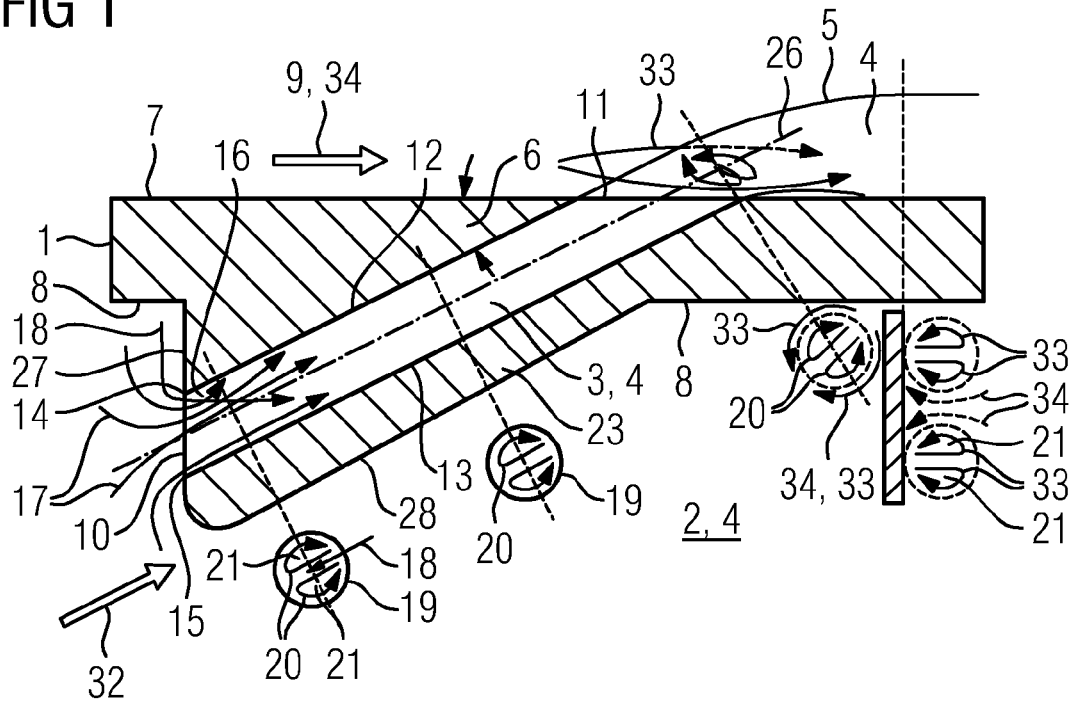
FIGS. 1 and 2 show a longitudinal detail of an outer wall of the turbine blade with a through duct and with a thickening.

FIGS. 1 to 6 show a portion of an outer wall 1 of a turbine blade of a turbomachine. The outer wall 1 delimits an inner cavity 2 and has an outer face 7 and an inner face 8. When the turbomachine is in operation, a hot gas flow 34 occurs on the outer face 7, with a hot gas main flow direction 9 which is parallel to the outer face 7 and which is directed toward the trailing edge of the turbine blade (not shown in the figures). A through duct 3 of circular cross section 19 is introduced into the outer wall 1 and is inclined with respect to the trailing edge of the turbine blade in the through-flow direction directed from the inside outward and forms an acute inclination angle 6 with the outer face 7.

The through duct 3 in FIGS. 1 to 6 has an entrance 10 on the inside and an exit 11 on the outside. Furthermore, the through duct 3 has an axis 26, an upstream side 12 and a downstream side 13. The entrance 10 of the through duct 3 has an upstream marginal portion 14 on the upstream side 12 and a downstream marginal portion 15 on the downstream side 13. When the turbomachine is in operation, the inner cavity 2 contains a cooling fluid 4 which penetrates via the entrance 10 into the through duct 3 and leaves the through duct 3 again via the exit 11. The inclination angle 6 selected is acute, in such a way that the cooling fluid 4, after leaving the through duct 3, forms a cooling film 5 on the outer face 7.

FIG. 1 shows an embodiment of the turbine blade with a thickening 23. The thickening 23 is arranged on the inside on that region of the outer wall 1 in which the through duct 3 is arranged. The thickening 23 has a downstream thickening rear side 28, which runs parallel to the through duct 3, and an upstream thickening front side 27, in which the entrance 10 is arranged. The thickening front side 27 is arranged essentially perpendicularly to the inner face 8 of the outer wall 1, the upstream marginal portion 14 being designed to be more sharp-edged than the downstream marginal portion 15.

The flow conditions at the turbine blade are described below with reference to FIG. 1. The downstream marginal portion 15 is blunt, in such a way that the cooling fluid flow 17 can follow this marginal portion 15 so as to be separation-free. The upstream marginal portion 14 is sharp-edged, in such a way that the cooling fluid flow 17 cannot follow this marginal portion 14, so that a separation zone 16 of the cooling fluid flow 17 is formed in the through flow duct 3 on the upstream side 12. The separation zone 16 induces in the through duct 3 a centric transverse flow 18 which is directed from the upstream side 12 to the downstream side 13. On account of the centric transverse flow 18, a contra-directional pair of vortices 20 with two vortex centers 21 is generated in the through duct 3, the velocity vectors between the two vortex centers 21 pointing toward the downstream side 13 of the through duct 3.

As is clear from FIG. 1, the velocity vectors of the cooling fluid flow 17 between the vortex centers 21, immediately after leaving the through duct 3, are directed toward the outer wall 1. The hot gas flow 34 flows around the emerging cooling air jet having the contra-directional pair of vortices 20, with the result that a chimney vortex 33 is formed from a hot gas. The chimney vortex 33 has two vortex arms which are arranged on opposite sides of the contra-directional pair of vortices 20. Each of the vortex arms is formed by a vortex, the velocity vectors of the hot gas flow 34 between the vortex centers 21 of the vortex arms being directed toward the outer wall 1. The hot gas is thereby transported onto the outer face 7 of the outer wall 1. The vortex arms have oppositely directed directions of rotation to the vortices, in each case overlaid with them, of the pair of contra-directional vortices 20 immediately after leaving the through duct 3, so that the chimney vortex 33 is weakened and the transport of the hot gas onto the outer face 7 of the outer wall 1 is reduced, with the result that the introduction of heat into the outer wall 1 of the turbine blade is diminished.

It is conceivable that the thickening front side 27 is inclined with respect to the trailing edge of the turbine blade, the upstream marginal portion 14 being designed to be even more sharp-edged than in FIG. 1.

Figure 2:
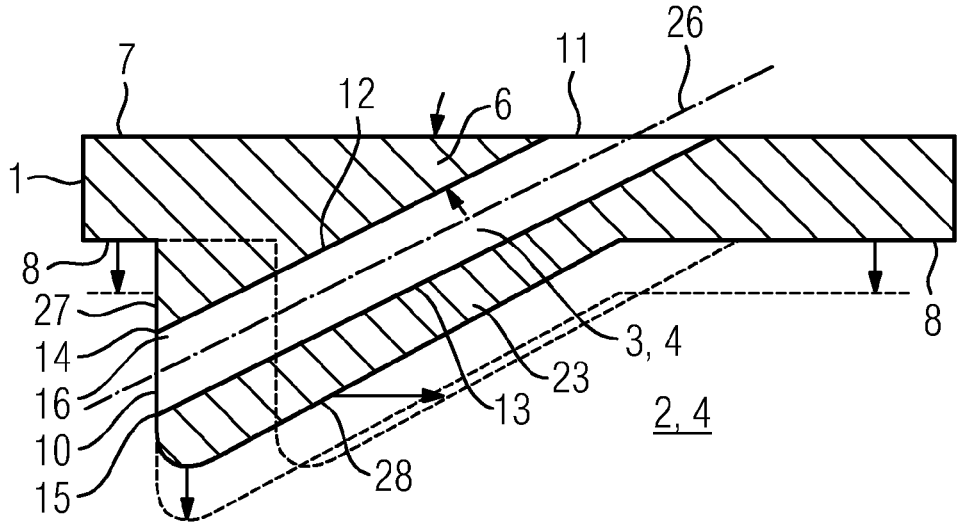

FIG. 2 illustrates the thickening 23 from FIG. 1, with two extreme manufacturing inaccuracies, in each case indicated by a dashed line, in the case of the first manufacturing inaccuracy an offset of the thickening 23 parallel to the outer wall 1 occurring, and in the case of the second manufacturing inaccuracy an offset parallel to the thickening front side 27 occurring. In the case of both manufacturing inaccuracies, the through duct 3 is arranged within the thickening 23 and the entrance 10 is arranged in the thickening front side 27.

Figure 3:
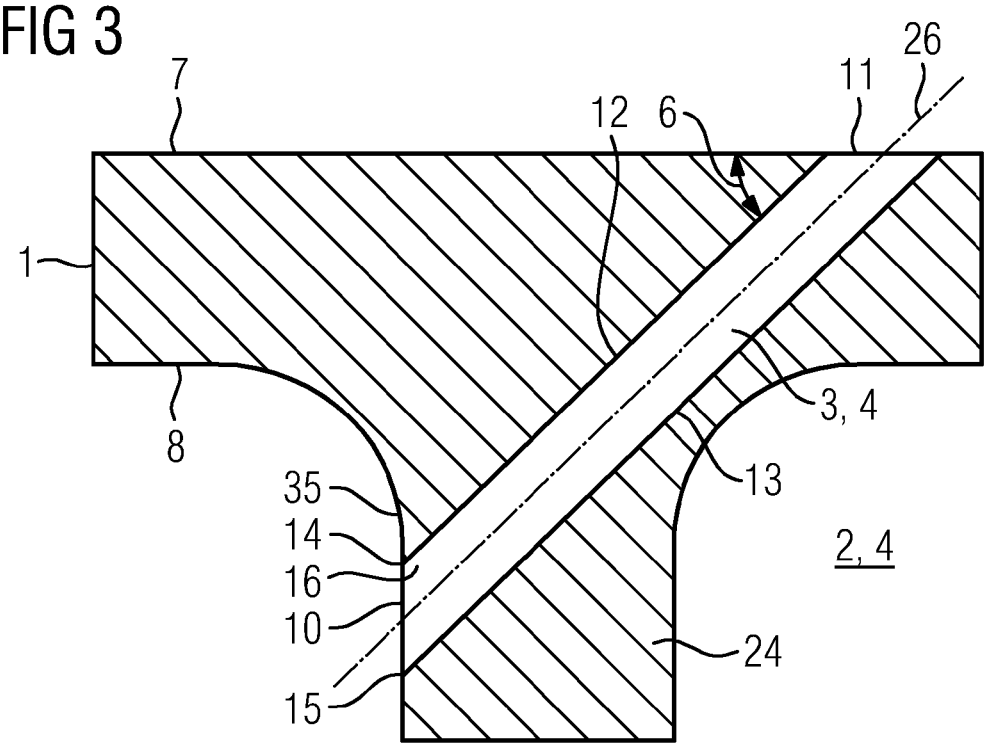
FIG. 3 shows a longitudinal detail of an outer wall of the turbine blade with a through duct and with a supporting web.

The embodiment of the turbine blade from FIG. 3 has a supporting web 24 running from the pressure side of the turbine blade to its suction side. The through duct 3 runs partially in the supporting web 24 and the entrance 10 is arranged in the upstream supporting web front side 35.

Figure 4:
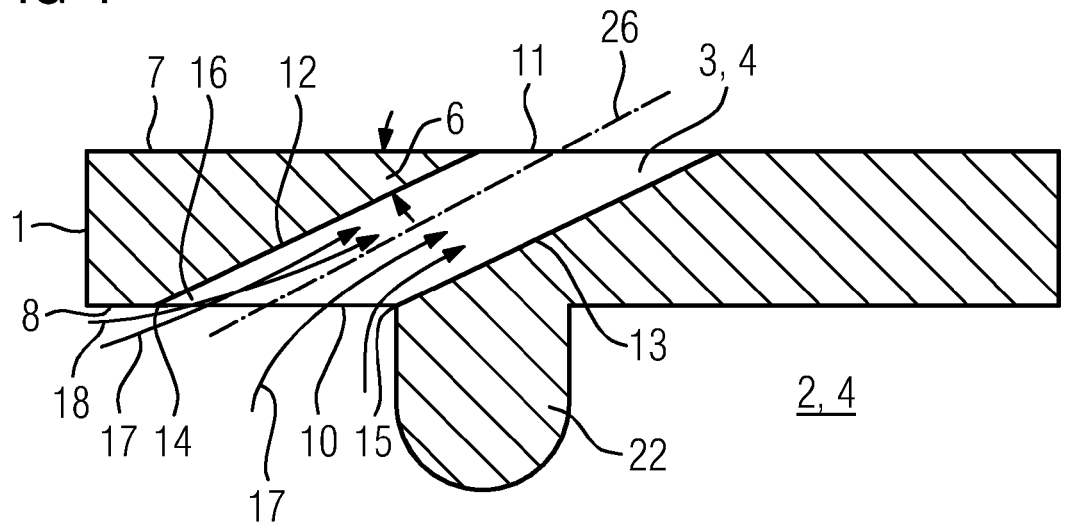
FIG. 4 shows a longitudinal detail of an outer wall of the turbine blade with a through duct and with a bead.

As is clear from FIG. 4, a bead 22 is integrally formed on the inner face 8 of the outer wall 1 directly adjacently to the downstream marginal portion 15, with the result that the downstream marginal portion 15 is of blunt form. The bead 22 has a convex region on its inwardly directed side. It is conceivable that the convex region extends as far as the downstream marginal portion 15 and/or into the through duct 3. In this case, a separation zone could be avoided especially effectively on the downstream side 13 of the through duct 3. It is conceivable that the bead 22 is designed with rectangular cross section. It is conceivable, furthermore, that the bead 22 is also designed as a cooling rib.

Figure 5:
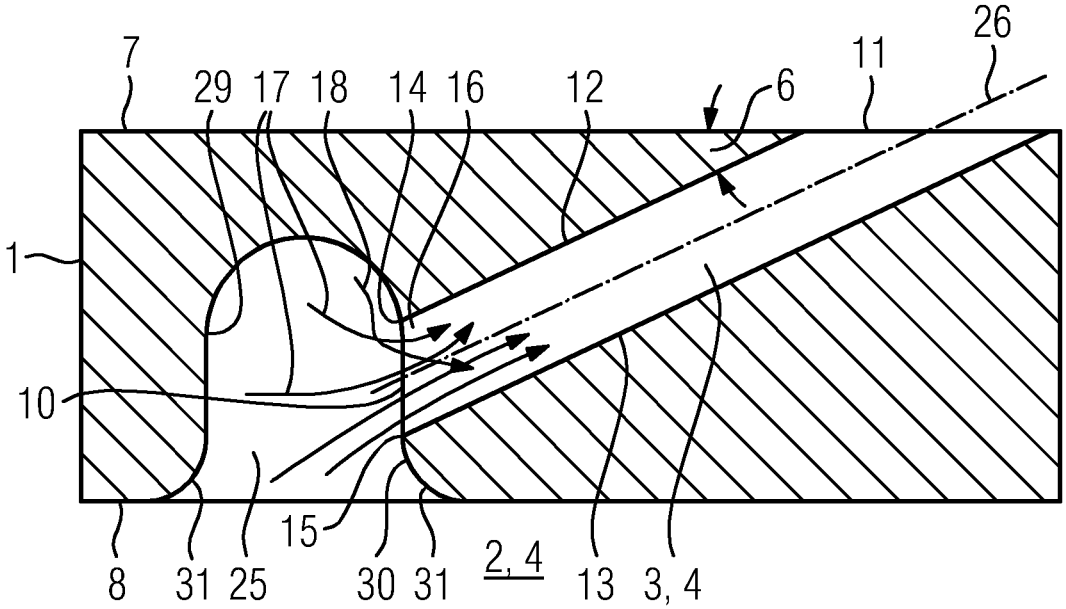
FIGS. 5 and 6 show a longitudinal detail of an outer wall of the turbine blade with a through duct and with a clearance.
Figure 6:
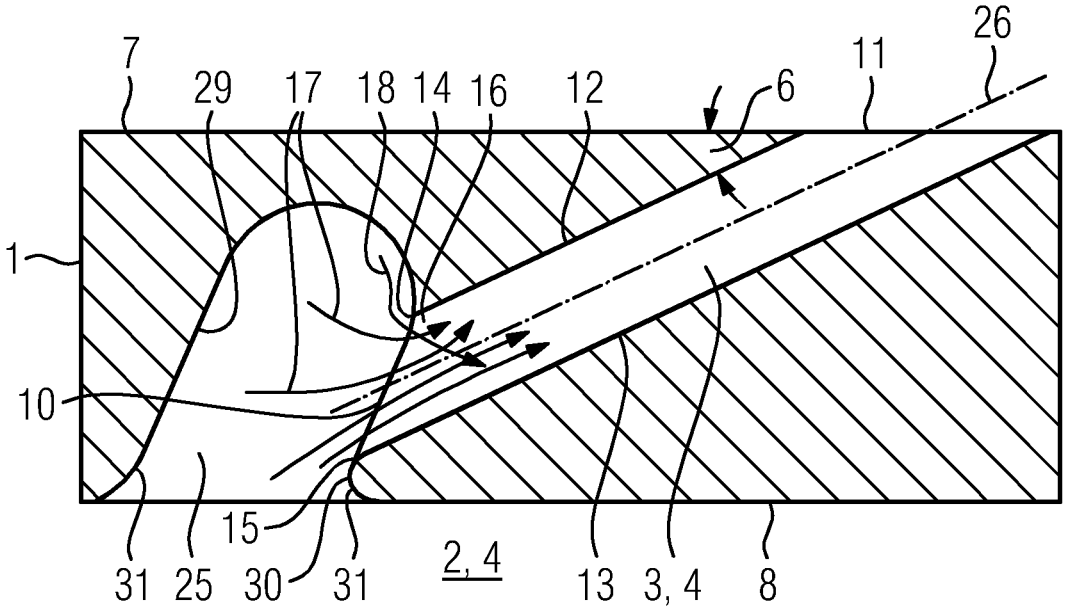

In the embodiments according to FIGS. 5 and 6, a hat-shaped clearance 25 with an upstream clearance front side 29 and with a downstream clearance rear side 30 is arranged in the outer wall. The entrance 10 is arranged in the clearance rear side 30. The clearance 25 has a clearance inlet margin 31 of round shape, in order to avoid a separation of the cooling fluid flow 17 when it enters the clearance 25. In contrast to the embodiment from FIG. 5, the clearance 25 of the embodiment from FIG. 6 is inclined with respect to the trailing edge of the turbine blade, the upstream marginal portion 14 being designed to be especially sharp-edged. It is conceivable, furthermore, that the clearance 25 is designed as a groove into which a plurality of through ducts 3 lead.

While specific embodiments have been described in detail, those with ordinary skill in the art will appreciate that various modifications and alternative to those details could be developed in light of the overall teachings of the disclosure. For example, elements described in association with different embodiments may be combined. Accordingly, the particular arrangements disclosed are meant to be illustrative only and should not be construed as limiting the scope of the claims or disclosure, which are to be given the full breadth of the appended claims, and any and all equivalents thereof. It should be noted that the term "comprising" does not exclude other elements or steps and the use of articles "a" or "an" does not exclude a plurality.

The invention claimed is:

1. A turbine blade for a turbomachine, comprising:

an outer wall which delimits an inner cavity of the turbine blade, wherein cooling fluid is provided in the inner cavity for film-cooling of the turbine blade, at least one through duct arranged in the outer wall, wherein the cooling fluid flows through the at least one through duct from the inner cavity to an outside of the turbine blade so as to form a cooling film on an outer face of the outer wall, wherein the at least one through duct is inclined with respect to a trailing edge of the turbine blade, wherein a marginal portion of an entrance of the at least one through duct is designed to be sharp-edged on an upstream side in relation to other marginal portions of the entrance such that a separation zone of a cooling fluid flow is formed in the at least one through duct, wherein the separation zone induces a centric transverse flow of the cooling fluid which is directed toward a side of the at least one through duct which lies opposite the separation zone, wherein a pair of contra-directional vortices develops in the at least one through duct such that velocity vectors of the cooling fluid flow between vortex centers point toward a downstream side of the at least one through duct, and a clearance provided on an inner face of the outer wall in which the at least one through duct is arranged, wherein the clearance is hat-shaped such that the clearance includes a clearance inlet margin that is rounded, wherein the clearance has a downstream rear side in which the entrance is formed and the entrance is inclined with respect to an axis of the at least one through duct such that the marginal portion of the entrance of the at least one through duct is designed on the upstream side to be more sharp-edged than an opposite marginal portion of the entrance.

2. The turbine blade as claimed in claim 1, wherein the rear side of the clearance is arranged essentially perpendicularly to the inner face of the outer wall or at an inclination with respect to the trailing edge of the turbine blade.

3. The turbine blade as claimed in claim 1, wherein the clearance is of round shape at an inlet margin such that the cooling fluid flows into the clearance free of separation.

4. The turbine blade as claimed in claim 1, wherein the clearance is a groove, and wherein a plurality of through ducts leads into the groove.

* * * * *